US011371113B2

(12) United States Patent
Irnich et al.

(10) Patent No.: US 11,371,113 B2
(45) **Date of Patent: *Jun. 28, 2022**

(54) HOT-ROLLED FLAT STEEL PRODUCT AND METHOD FOR THE PRODUCTION THEREOF

(71) Applicants: ThyssenKrupp Steel Europe AG, Duisburg (DE); thyssenkrupp AG, Essen (DE)

(72) Inventors: Manuela Irnich, Rheinberg (DE); Rainer Fechte-Heinen, Bottrop (DE); Jens Horstmann, Duesseldorf (DE); Richard Georg Thiessen, Malden (NL)

(73) Assignee: Evonik Operations GmbH, Essen (DE)

( * ) Notice: Subject to any disclaimer, the term of this patent is extended or adjusted under 35 U.S.C. 154(b) by 109 days.

This patent is subject to a terminal disclaimer.

(21) Appl. No.: 16/466,894

(22) PCT Filed: Dec. 6, 2017

(86) PCT No.: PCT/EP2017/081620
§ 371 (c)(1),
(2) Date: Jun. 5, 2019

(87) PCT Pub. No.: WO2018/108653
PCT Pub. Date: Jun. 21, 2018

(65) Prior Publication Data

US 2020/0071785 A1 Mar. 5, 2020

(30) Foreign Application Priority Data

Dec. 14, 2016 (WO) ..... PCT/EP2016/080935

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46; C21D 6/002; C21D 6/005; C21D 6/008; C21D 8/0205; C21D 8/0226;
(Continued)

(56) References Cited

U.S. PATENT DOCUMENTS 9,567,659 B2 2/2017 Somani et al.
9,650,708 B2 * 5/2017 Becker ..... C21D 6/002
(Continued)

FOREIGN PATENT DOCUMENTS

CA 2734976 A1 3/2010
CN 101932745 A 12/2010
(Continued)

OTHER PUBLICATIONS

Wright et al., "A Review of Strain Analysis Using Electron Backscatter Diffraction", Microscopy and Microanalysis, 2011, pp. 316-329, vol. 17, No. 3.

*Primary Examiner* — Anthony M Liang
(74) *Attorney, Agent, or Firm* — The Webb Law Firm

(57) ABSTRACT

A hot-rolled flat steel product including (in wt %) C: 0.1-0.3%, Mn: 1.5-3.0%, Si: 0.5-1.8%, Al: ≤1.5%, P: ≤0.1%, S: ≤0.03%, N: ≤0.008%, optionally one or more of Cr: 0.1-0.3%, Mo: 0.05-0.25%, Ni: 0.05-2.0%, Nb: 0.01-0.06%, Ti: 0.02-0.07%, V: 0.1-0.3%, and B: 0.0008-0.0020%, the balance being iron and unavoidable impurities. This flat steel product possesses a tensile strength of 800-1500 MPa, a yield strength of >700 MPa, an elongation at break of 7-25%, and a hole expansion of more than 20%. The
(Continued)

structure is at least 85 area % martensite, of which at least half is tempered martensite, with the remainder being ≤15 vol % residual austenite, ≤15 area % bainite, ≤15 area % polygonal ferrite, ≤5 area % cementite and/or ≤5 area % nonpolygonal ferrite, and has a kernel average misorientation of at least 1.50°. Also, a method for producing the flat steel product, wherein the microstructure of the flat steel product is set by the heat treatment.

21 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/44*** | (2006.01) |
| ***C22C 38/48*** | (2006.01) |
| ***C22C 38/58*** | (2006.01) |
| ***C21D 9/663*** | (2006.01) |

(52) U.S. Cl.
CPC ..... *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/26* (2013.01); *C22C 38/28* (2013.01); *C22C 38/32* (2013.01); *C22C 38/38* (2013.01); *C22C 38/44* (2013.01); *C22C 38/48* (2013.01); *C22C 38/58* (2013.01); *C21D 9/663* (2013.01); *C21D 2211/001* (2013.01); *C21D 2211/008* (2013.01)

(58) Field of Classification Search
CPC ..... C21D 8/0263; C21D 9/663; C21D 2211/001; C22C 38/001; C22C 38/002; C22C 38/02; C22C 38/04; C22C 38/06; C22C 38/12; C22C 38/14; C22C 38/22; C22C 38/26; C22C 38/28; C22C 38/32; C22C 38/38; C22C 38/44; C22C 38/48; C22C 38/58
See application file for complete search history.

(56) References Cited

U.S. PATENT DOCUMENTS

| | | | | |
|---|---|---|---|---|
| 2001/0015245 | A1 | 8/2001 | Eberle et al. | |
| 2006/0011274 | A1 | 1/2006 | Speer et al. | |
| 2011/0146852 | A1 | 6/2011 | Matsuda et al. | |
| 2011/0198002 | A1 | 8/2011 | Nakagaito et al. | |
| 2012/0132327 | A1* | 5/2012 | Mukai | C22C 38/14 148/660 |
| 2013/0133786 | A1 | 5/2013 | Matsuda et al. | |
| 2013/0251984 | A1 | 9/2013 | Schepers et al. | |
| 2014/0147329 | A1 | 5/2014 | Jun et al. | |
| 2014/0230969 | A1 | 8/2014 | Sugimoto et al. | |
| 2014/0299237 | A1 | 10/2014 | Somani et al. | |
| 2015/0000797 | A1 | 1/2015 | Sebald et al. | |
| 2015/0017471 | A1* | 1/2015 | Shuto | B32B 15/01 428/659 |
| 2015/0086808 | A1* | 3/2015 | Kasuya | C23C 2/28 428/659 |
| 2016/0160310 | A1* | 6/2016 | Hasegawa | C22C 38/38 148/537 |
| 2020/0040420 | A1* | 2/2020 | Minami | C21D 9/46 |

FOREIGN PATENT DOCUMENTS

| | | | | |
|---|---|---|---|---|
| CN | 103221556 | A | | 7/2013 |
| CN | 104532129 | A | | 4/2015 |
| DE | 4104001 | A1 | | 8/1992 |
| EP | 2267176 | A1 | | 12/2010 |
| EP | 2546368 | A1 | | 1/2013 |
| EP | 2757170 | A1 | | 7/2014 |
| JP | 693340 | A | | 4/1994 |
| JP | 7197183 | A | | 8/1995 |
| JP | 2009209450 | A | | 9/2009 |
| JP | 201090475 | A | | 4/2010 |
| JP | 2010285636 | A | | 12/2010 |
| JP | 2011184757 | A | | 9/2011 |
| JP | 20154081 | A | | 1/2015 |
| JP | 2015196891 | A | | 11/2015 |
| JP | 2016194158 | A | | 11/2016 |
| JP | 2016194158 | A | * | 11/2016 |
| KR | 1020120121810 | A | | 11/2012 |
| WO | 2004022794 | A1 | | 3/2004 |
| WO | 2013004910 | A1 | | 1/2013 |
| WO | 2014009404 | A1 | | 1/2014 |
| WO | 2016177420 | A1 | | 11/2016 |

* cited by examiner

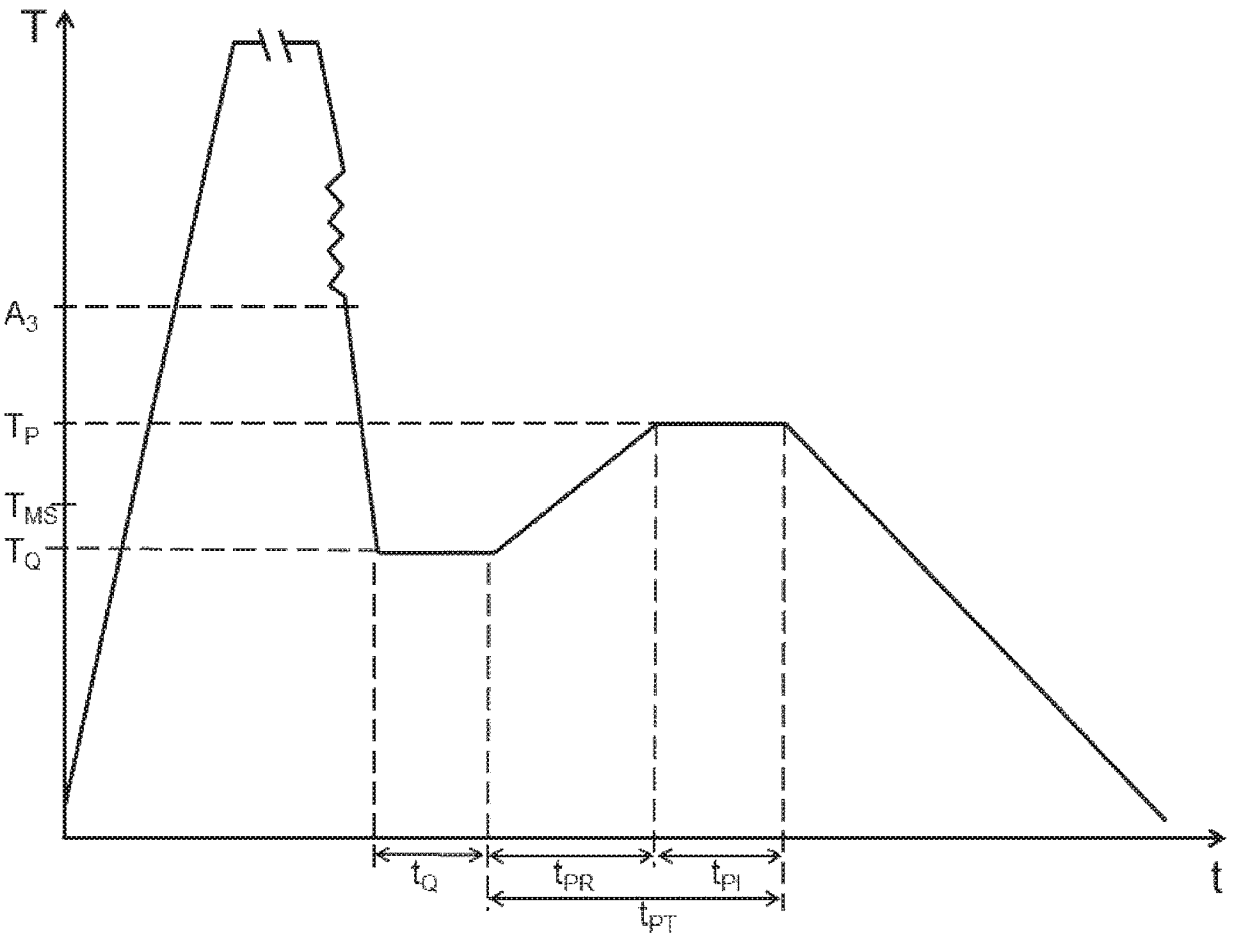
T
A3
TP
TMS
TQ
t
tQ
tPR
tPI
tPT

HOT-ROLLED FLAT STEEL PRODUCT AND METHOD FOR THE PRODUCTION THEREOF

CROSS-REFERENCE TO RELATED APPLICATIONS

This application is the United States national phase of International Application No. PCT/EP2017/081620 filed Dec. 6, 2017, and claims priority to International Application No. PCT/EP2016/080935 filed Dec. 14, 2016, the disclosures of which are hereby incorporated by reference in their entirety.

BACKGROUND OF THE INVENTION

Field of the Invention

The invention relates to a hot-rolled flat steel product possessing mechanical properties ideally harmonized with one another, such as high tensile strengths Rm, high yield strengths Rp and high elongations at break A, in combination with good formability, as characterized by a high hole expansion value, for which, "λ" ("lambda") is introduced as an abbreviation. Furthermore, hot-rolled flat steel products of the invention are notable for good long-term strength and wear resistance.

The invention also relates to a process for producing a flat steel product of this kind.

Description of Related Art

When reference is made here to flat steel products, what is meant by these are products of rolling, such as strips or sheets, or plates and blanks divided off from them, each having a width and length which are substantially greater than their thickness.

When figures are given here for alloy contents, they are based on the weight or mass, unless expressly indicated otherwise. Figures for levels of structure constituents except for the figures for the levels of residual austenite, which are reported in vol % —are based generally on the area as viewed in a polished section, unless otherwise indicated. Figures for the composition of an atmosphere, conversely, are based on the particular volume under consideration, unless expressly indicated otherwise.

Flat steel products referred to as "Quench & Partitioning" products are notable for high strength in conjunction with high elongation and optimized deformability. In practice, flat steel products of this kind have to date been used as cold-rolled products with low sheet thicknesses.

Known from WO 2013/004910 A1 (EP2 726 637), however, is a process for producing high-strength construction steels, and products consisting thereof, wherein, first of all, slabs of a suitably selected steel alloy are heated to 950-1300° C. and held until the temperature distribution within the slabs is uniform. The steel from which the slabs are made is intended typically to consist of (in wt %) 0.17-0.23% C, 1.4-2.0% Si, or in sum total 1.2-2.0% Al and Si, if Al is present, 1.4-2.3% Mn and 0.4-2.0% Cr, optionally up to 0.7% Mo, the balance being iron and unavoidable impurities. After the annealing treatment, the slabs pass through hot-rolling, in which they are rolled within a temperature range which lies below the recrystallization temperature but above the A3 temperature. After the end of hot rolling, the resultant hot strip is quenched with a quenching rate of at least 20° C./s down to a quenching stop temperature which is in the temperature range between the temperature Ms at which martensite formation begins and the temperature Mf at which martensite formation has finished. The quenching stop temperature here is typically in the region of more than 200° C. and less than 400° C. The hot strip thus quenched is subjected to a "partitioning treatment" in order to transfer carbon from the martensitic to the austenitic structure constituents. Lastly, the hot strip thus treated is cooled to room temperature. In this publication, key parameters of the quenching and partitioning treatment remain unresolved.

SUMMARY OF THE INVENTION

Against the background of the above-elucidated prior art, the object of the invention was to provide a flat steel product having a larger sheet thickness and an optimized combination of properties.

The intention was also to specify a process for the inexpensive and operationally reliable production of such a product.

BRIEF DESCRIPTION OF THE DRAWING

FIG. 1 shows a schematic view of the production of a hot-rolled flat steel product according to the invention.

DESCRIPTION OF THE INVENTION

The invention provides a hot-rolled flat steel product and a process suitable for its production.

A hot-rolled flat steel product constituted in accordance with the invention and a hot-rolled flat steel product produced in accordance with the invention consist, accordingly, of a steel having the following composition (in wt %):

C: 0.1-0.3%
Mn: 1.5-3.0%
Si: 0.5-1.8%
Al: up to 1.5%
P: up to 0.1%
S: up to 0.03%
N: up to 0.008%,
optionally one or more elements of the "Cr, Mo, Ni, Nb, Ti, V, B" group having levels as follows:
Cr: 0.1-0.3%
Mo: 0.05-0.25%
Ni: 0.05-2.0%
Nb: 0.01-0.06%
Ti: 0.02-0.07%
V: 0.1-0.3%
B: 0.0008-0.0020%,
the balance being iron and production-related unavoidable impurities.

Here, a hot-rolled flat steel product of the invention is notable in that

- the flat steel product has a tensile strength Rm of 800-1500 MPa, a yield strength Rp of more than 700 MPa, an elongation at break A of 7-25%, and a hole expansion λ of more than 20%,
- the structure of the flat steel product consists to an extent of at least 85 area % of martensite, of which at least half is tempered martensite, with the respective remainder of the structure consisting of up to 15 vol % residual austenite, of up to 15 area % bainite, of up to 15 area % polygonal ferrite, of up to 5 area % cementite and/or of up to 5 area % nonpolygonal ferrite, and
- the structure of the flat steel product has a kernel average misorientation KAM of at least 1.50°.

Carbon "C" is present at levels of 0.1-0.3 wt % in the steel melt processed in accordance with the invention. Primarily, C plays a major role in the formation of austenite. A sufficient concentration of C permits complete austenitization at temperatures of up to 930° C., which are below the rolling end temperatures typically selected in the hot-rolling of steels of the type in question here. As early as during quenching, part of the residual austenite is stabilized by the carbon provided in accordance with the invention. Furthermore, there is additional stabilization during the later partitioning step. The strength of the martensite which is formed during the first cooling step (θQ) or during the last cooling step (θP2) is likewise heavily dependent on the C content of the steel composition processed in accordance with the invention. At the same time, however, as the C content rises, the martensite start temperature is shifted to ever lower temperatures. Too high a C content, therefore, would lead to hindrances at production, since the quench temperature attainable would shift to very low temperatures. Furthermore, the C content of a steel processed in accordance with the invention, in comparison to other alloy elements, makes the greatest contribution to a higher CE, with a consequent negative effect on weldability. The CE indicates which alloy elements adversely affect the weldability of the steel. The CE can be calculated as follows:

$$CE=\%\ C+[(\%\ Si+\%\ Mn)/6]+[(\%\ Cr+\%\ Mo+\%\ V)/5]+[(\%\ Cu+\%\ Ni)/15]$$

where (in each case in wt %) % C=C content of the steel, % Si=Si content of the steel, % Mn=Mn content of the steel, % Cr=Cr content of the steel, % Mo=Mo content of the steel, % V=V content of the steel, % Cu=Cu content of the steel, % Ni=Ni content of the steel.

With the C content mandated in accordance with the invention, it is possible to exert a targeted influence over the strength level of the end product.

Manganese "Mn" is an important element for the hardenability of the steel. At the same time, manganese reduces the propensity toward unwanted formation of pearlite during cooling. These properties permit the establishment of a suitable starting structure of martensite and residual austenite after the first quenching with cooling rates<100 K/s in accordance with the process of the invention. Too high a concentration of Mn is detrimental to the elongation and the CE, in other words the weldability. The Mn content is therefore limited to 1.5-3.0 wt %. Optimized harmonization of the strength properties can be achieved by an Mn content of 1.9-2.7 wt %.

Silicon "Si" has an important part in suppressing the formation of pearlite and controlling the formation of carbide. Formation of cementite would bind carbon which would therefore no longer be available for the further stabilization of the residual austenite. On the other hand, too high Si content impairs the elongation at break and also the surface quality, because of accelerated formation of red scale. A comparable effect can be triggered by the alloying of Al. Setting the product properties envisaged in accordance with the invention requires a minimum of 0.7 wt % Si. The desired structure can be set with particular reliability if levels of at least 1.0 wt % Si are present in the flat steel product of the invention. 1.8 wt % Si is prescribed as an upper limit on the Si content, in view of the target elongation at break, and a restriction to a maximum of 1.6 wt % Si gives flat steel products an optimized surface quality. Depending on the respective Al content of the flat steel product of the invention, the Si content can also be set at 0.5-1.1 wt %, more particularly 0.7-1.0 wt %, in accordance with the elucidations in the following paragraph.

Aluminum "Al" is used for deoxidation and for binding any nitrogen present. Furthermore, as already mentioned, Al can also be used to suppress cementite, but is not as effective as Si. An increased addition of Al, however, does significantly increase the austenitization temperature, and so the suppression of cementite is preferably realized only by Si. In this case, an Al content of 0-0.03 wt % is envisaged, which is favorable in terms of the austenitization temperature, if at the same time Si is present at levels of at least 1.0 wt %. If, on the other hand, the Si content is limited in order, for example, to set an optimized surface quality, i.e., set to levels between 0.5-1.1 wt %, preferably 0.7-1.0 wt %, then Al must be alloyed in at a minimum level of 0.5 wt % in order to suppress cementite. In one preferred implementation, the Al content can be set to levels of at least 0.01 wt % for particularly reliable generation of deoxidized melts. Limiting the Al content to a maximum of 1.5 wt %, preferably a maximum of 1.3 wt %, is undertaken in order to avoid problems during the casting of the steel.

Phosphorus "P" has adverse effects on weldability. The amount thereof in the hot strip of the invention or in the melt processed in accordance with the invention is therefore 0.1 wt % at most, and P contents of up to 0.02 wt %, more particularly less than 0.02 wt %, may be advantageous.

Sulfur "S" at relatively high concentrations leads to the formation of MnS or (Mn, Fe) S, which has adverse consequences for the elongation. To avoid this effect, the S content is limited to a maximum of 0.03 wt %, and there may be advantage in limiting the S contents to a maximum of 0.003 wt %, more particularly less than 0.003 wt %.

Nitrogen "N" leads to the formation of nitrides, which negatively impact the formability. The N content is therefore to be less than 0.008 wt %. Employing high levels of technical effort, it is possible to realize very low N contents of, for example, less than 0.0010 wt %. To reduce the technical complexity, the N content may be set preferably to at least 0.0010 wt % and more preferably to at least 0.0015 wt %.

The alloy elements collected in the "Cr, Mo., Ni, Nb, Ti, V, B" group may optionally be added individually, jointly or in various combinations, in accordance with the pointers explained below, in order to set particular properties of the flat steel product of the invention.

Chromium ("Cr") is an effective inhibitor of pearlite and may therefore lower the required minimum cooling rate. To achieve this, Cr is added to the steel processed in accordance with the invention or to the steel of the hot-rolled flat steel product of the invention. For the effective establishment of this effect, a minimum proportion of 0.10 wt % Cr, preferably 0.15 wt % Cr, is needed. At the same time, the strength is greatly increased by the addition of Cr and, moreover, there is a risk of pronounced grain boundary oxidation. The formation of chromium oxides in the near-surface region of the steel also makes possible coatability more difficult, and unwanted surface defects may occur. In the event of cyclic loading of the material, these surface defects may lead to a deterioration in long-term strength and therefore to a premature failure of the material. Furthermore, too high a proportion of Cr impairs the deformability of the steel; in particular, it is impossible to ensure good hole expansion λ of greater than 20%. Accordingly, the Cr content is limited to not more than 0.30 wt %, preferably a maximum of 0.25 wt %.

Molybdenum "Mo" is likewise a very effective element in suppressing the formation of pearlite. To achieve this effect, the steel may be admixed optionally with at least 0.05 wt %, more particularly at least 0.1 wt %. Additions of more than 0.25 wt % make no sense from the standpoint of effectiveness.

Nickel "Ni", like Cr, is an inhibitor of pearlite and is effective even in small amounts. With optional alloying with Ni of at least 0.05 wt %, more particularly at least 0.1 wt %, at least 0.2 wt % or at least 0.3 wt %, this supporting effect can be achieved. In light of the desired setting of the mechanical properties, it is useful at the same time to limit the Ni content to not more than 2.0 wt %; Ni contents of at most 1.0 wt %, more particularly 0.5 wt %, have emerged as being particularly practical.

The steel of a flat steel product of the invention may optionally also comprise micro-alloy elements, such as vanadium "V", titanium "Ti" or niobium "Nb", which contribute to greater strength by forming very finely divided carbides (or carbonitrides in the simultaneous presence of nitrogen "N"). The presence of Ti, V or Nb, moreover, leads to a freezing of the grain boundaries and phase boundaries after the hot-rolling operation during the partitioning step, which makes the grain finer and so promotes the desired combination of strength and formability properties. The minimum level at which a significant effect is apparent is 0.02 wt % for Ti, 0.01 wt % for Nb and 0.1 wt % for V. Too high a concentration of the micro-alloy elements, however, leads to the formation of excessive and coarse carbides and hence to the binding of carbon, which is then no longer available for the stabilization of the residual austenite in accordance with the invention. Moreover, the formation of excessively coarse carbides has an adverse effect on the desired high long-term strength. In accordance with the mode of action of the individual elements, therefore, the upper limit is specified as 0.07 wt % for Ti, 0.06 wt % for Nb and 0.3 wt % for V.

Likewise optional additions of boron "B" segregate to the phase boundaries and hinder their mobility. This leads to a fine-grain structure, which may be advantageous for the mechanical properties. When this alloy element is used, therefore, a minimum B content of 0.0008 wt % should be observed. If B is alloyed in, however, there must be sufficient Ti for the binding of the N. The effect of B becomes saturated at a level of around 0.0020 wt %, which is also given as the upper limit.

A flat steel product hot-rolled in accordance with the invention has a tensile strength Rm of 800-1500 MPa, a yield strength Rp of more than 700 MPa, and an elongation at break A of 7-25%; the tensile strength Rm, the yield strength Rp and the elongation at break A here are determined in accordance with DIN EN ISO 6892-1-2009-12.

At the same time, hot strip of the invention is notable for very good formability, as reflected in a hole expansion λ, determined according to DIN ISO 16630, of more than 20%.

Hot strip constituted in accordance with the invention and more particularly produced by the process of the invention has a structure of tempered and non-tempered martensite with fractions of residual austenite; there may likewise be bainite, polygonal ferrite, non-polygonal ferrite and cementite in small fractions in the structure. The martensite fraction of the structure is at least 85 area %, preferably at least 90 area %, of which at least half is tempered martensite. The fraction of residual austenite in a hot-rolled flat steel product of the invention, accordingly, is at most 15 vol %. Likewise, in each case at the expense of the residual austenite, there may be up to 15 area % bainite, up to 15 area % polygonal ferrite, up to 5 area % cementite and/or up to 5 area % non-polygonal ferrite, respectively, in the structure. In one preferred implementation, the fraction of the polygonal ferrite and also the fraction of the non-polygonal ferrite amounts to 0 area %, since in this case the values for the hole expansion are particularly high, owing to the retarded cracking, in a predominantly martensitic structure with uniform hardness.

The structure of the hot strip of the invention is very fine, and so it is barely possible to assess it by means of customary optical light microscopy. Assessment by means of scanning electron microscopy (SEM) with at least 5000-times magnification is therefore recommended. Even after high magnification, however, the maximum permissible residual austenite fraction is difficult to determine. A recommendation is therefore made of quantitative determination of the residual austenite by means of X-ray diffraction (XRD) according to ASTM E975.

The structure of the hot-rolled flat steel product of the invention is characterized by a defined, local misorientation in the crystal lattice. This is especially so for the target fraction of primary martensite in the structure, i.e., the martensite fraction formed during the first cooling. Said local misorientation is quantified by what is called "kernel average misorientation", KAM for short, which is greater than or equal to 1.50°, preferably greater than 1.55°. The KAM ought to be at least 1.50°, since in that case there is a homogeneous resistance to deformation in the grain through uniform lattice distortion. In this way it is possible to prevent a locally restricted preliminary damage to the multiphase structure at the start of a deformation. If the KAM is below 1.50°, the structure present is too greatly tempered, causing strength properties outside the target spectrum for the invention.

Consequently, besides the pure phase fractions, a factor critical to the mechanical properties of a steel product produced and constituted in accordance with the invention is, in particular, the distortion of the crystal lattice. This lattice distortion represents a measure of the initial resistance to plastic deformation, and is property-determining in view of the target strength ranges. A suitable method for measuring and therefore quantifying the lattice distortion is that of electron backscatter diffraction (EBSD). With EBSD, a very large number of local diffraction measurements are generated and combined in order to ascertain small differences and profiles and also local misorientations in the structure. One EBSD evaluation method common in practice is the aforementioned kernel average misorientation (KAM), where the orientation of one measurement point is compared with that of the neighboring points. Beneath a threshold value, typically of 5°, adjacent points are assigned to the same (distorted) grain. Above this threshold value, the adjacent points are assigned to different (sub) grains. Because of the very fine structure, a maximum step width of 100 nm is advised for the EBSD evaluation method. In order to evaluate the steels depicted in this invention notification, the KAM is evaluated in each case in relation between the current measurement point and its third-nearest neighboring point. A product in accordance with the invention must then have a mean KAM value from a measurement region of at least 75 μm×75 μm of ≥1.50°, preferably >1.55°. A more detailed depiction relating to determination of the KAM is found in Wright, S. I., Nowell, M. M., Fielda, D. A., Review of Strain Analysis Using Electron Backscatter Diffraction, Microsc. Microanal. 17, 2011: 316-329.

A process of the invention for producing a hot-rolled flat steel product constituted in accordance with the invention comprises at least the following operations:

a) melting of a steel alloy, whose composition and variants have already been elucidated above in connection with the hot-rolled flat steel product of the invention, and which, accordingly, has the following composition (in wt %): 0.1-0.3% C, 1.5-3.0% Mn, 0.5-1.8% Si, up to 1.5% Al, up to 0.1% P, up to 0.03% S, up to 0.008% N, optionally one or more elements of the "Cr, Mo., Ni, Nb, Ti, V, B" group at the following levels: 0.1-0.3% Cr, 0.05-0.25% Mo, 0.05-2.0% Ni, 0.01-0.06% Nb, 0.02-0.07% Ti, 0.1-0.3% V, 0.0008-0.0020% B, the balance being iron and production-relatedly unavoidable impurities;

b) casting of the melt to give a semi-finished product, such as a slab or thin slab;

c) heating-through of the semi-finished product to a heating temperature TWE of 1000-1300° C.;

d) hot-rolling of the heated-through semi-finished product to give a hot strip having a thickness of 1.0-20 mm, the hot-rolling being ended at a hot-rolling end temperature TET for which TET>(A3−100° C.), where "A3" designates the respective A3 temperature of the steel;

e) first quenching of the hot strip, starting from the hot-rolling end temperature TET, at a cooling rate θQ of more than 30 K/s, to a quench temperature TQ, for which RT<TQ<(TMS+100° C.), where "RT" designates the room temperature and "TMS" the martensite start temperature of the steel, and where the martensite start temperature TMS is determined as follows:

$$TMS[^\circ C.]=462-273\%\ C-26\%\ Mn-13\%\ Cr-16\%\ Ni-30\%\ Mo$$

where (in each case in wt %) % C=C content of the steel, % Mn=Mn content of the steel, % Cr=Cr content of the steel, % Ni=Ni content of the steel, % Mo=Mo content of the steel;

f) optional coiling of the flat steel product, quenched to the quench temperature TQ, to give a coil;

g) holding of the flat steel product, cooled to the quench temperature TQ, within a temperature range from TQ −80° C. to TQ +80° C. over a time of 0.1-48 hours;

h) heating of the flat steel product to a partitioning temperature TP or holding of the flat steel product at a partitioning temperature TP which is at least equal to the temperature TQ+/−80° C. of the flat steel product as present after the operation g), and is at most 500° C., over a partitioning time tPT of 0.5-30 hours; in the event that heating takes place, the heating rate θP1 is at most 1 K/s;

i) cooling of the flat steel product to room temperature;

j) optional descaling of the flat steel product;

k) optional coating of the flat steel product.

The technical production of hot strip according to the invention is shown schematically in FIG. 1 and is elucidated in detail below.

Operation a):

The alloying of the steel melt melted in accordance with the invention, and the variation possibilities thereof, are of course subject to the same points already given above in connection with the composition of the product according to the invention.

Operation b):

A semi-finished product is cast from the melt alloyed in accordance with the invention, this product typically being a slab or thin slab.

Operation c):

The semi-finished product is heated to a heating temperature TWE which is within the temperature range in which austenite forms in the steel of the invention. The heating temperature TWE of the steels of the invention ought in the case of the process of the invention, accordingly, to be at least 1000° C., since the strengths occurring during the subsequent hot-rolling procedure are too high if heating temperatures are lower. At the same time, the heating temperature ought at most to be 1300° C., in order to avoid partial melting of the slab surfaces.

The heating temperature TWE is preferably at least 1150° C., since in this way it is possible reliably to avoid structural inhomogeneities, which might arise, for example, as a result of manganese segregations.

By limiting the heating temperature TWE to a maximum of 1250° C., it is possible to provide for economic operation of the heating itself and of further process steps starting out from this temperature range.

Moreover, by setting the heating temperature TWE at 1150-1250° C., a defined structural state is set and a targeted dissolution of precipitates is achieved.

The heating to the temperature TWE may be carried out in a conventional pusher furnace or walking beam furnace. If the process of the invention is employed on a conventional thin slab casting line, in which the steel with composition in accordance with the invention is cast into thin slabs with a thickness of typically 40-120 mm (see DE 4104001 A1), the heating may also take place in the furnace which is traversed after the casting operation and is connected directly to the casting line.

Operation d):

After it has been heated, the semi-finished product is hot-rolled to give hot strip with final thicknesses of between 1.0 and 20 mm, preferably between 1.5 and 10 mm. Depending on the plant technology available, the hot-rolling may comprise a rough rolling, optionally carried out reversing, in a rough rolling stand, and a subsequent finish-rolling in what is called a finishing rolling line, consisting of a plurality of—typically five or seven—rolling stands which are traversed in a continuous sequence. The end rolling temperature TET in hot-rolling is to be set according to the proviso TET≥(A3−100° C.). It proves advantageous here for practical purposes if the end rolling temperature TET is set to be at least equal to the A3 temperature of the particular steel composition processed, or above the A3 temperature. Hence it may be advantageous to set the end rolling temperature TET in the region of 850-950° C. If, however, the process of the invention is to be carried out in such a way as to ensure the formation of certain fractions of polygonal ferrite in the structure, this can be achieved by selecting end rolling temperatures TET which are up to 100° C. below the respective A3 temperature of the steel. The A3 temperature of the particular steel composition being processed can be estimated in accordance with the equation (1) published by Andrews, J. in Iron and Steel Institute (203), pp. 721-727, 1965:

$$A3[^\circ C.]=910-203\sqrt{\%C}-15.2\%\ Ni+44.7\%\ Si+31.5\%\ Mo-30\%\ Mn+11\%\ Cr$$

where (in each case in wt %) % C=C content of the steel, % Ni=Ni content of the steel, % Si=Si content of the steel, % Mo=Mo content of the steel, % Mn=Mn content of the steel, % Cr=Cr content of the steel.

Operation e):

After the hot-rolling, the steel is quenched in a first quenching step, starting from the hot-rolling end temperature TET and at a high cooling rate, to a quench temperature TQ.

The cooling rate θQ here is more than 30 K/s.

The quench temperature TQ aimed at during cooling is on the one hand not below the room temperature. On the other hand it is at most 100° C. higher than the martensite start temperature TMS, at which the martensitic transformation begins.

The martensite start temperature TMS can be estimated using the following equation (2) developed by van Bohemen:

$$TMS[°\,C.]=462-273\%\,C-26\%\,Mn-13\%\,Cr-16\%\,Ni-30\%\,Mo$$

where % C=C content of the steel, % Mn=Mn content of the steel, % Cr=Cr content of the steel, % Ni=Ni content of the steel, % Mo=Mo content of the steel, in each case in wt %.

In the case of a quench temperature TQ above the martensite start temperature TMS, the desired fraction of primary martensite would not be formed. Instead, excessive fractions of ferrite, pearlite or bainite would be produced, in each case above the fractions mandated in accordance with the invention for the flat steel product of the invention. If the fractions of these structural constituents are too high, then the stabilization of the residual austenite during the partitioning treatment that follows the cooling is prevented. Moreover, during further cooling, the primary martensite formed would relax to such an extent, by self-tempering, that the KAM values aimed at in accordance with the invention would not be achieved. Furthermore, at quench temperatures TQ above the limit of TMS+100° C. as mandated by the invention, it is increasingly possible for inhomogeneities and hence segregations of individual elements to occur, which could in turn lead to the formation of a structure with unwanted banding.

A structure which is ideal in relation to the desired formability of the end product can therefore be achieved, in particular in relation to the primary martensite which forms during quenching, by a quench temperature TQ which is at most 100° C. greater than the martensite start temperature TMS and at least equal to the martensite start temperature TMS−250° C., in other words such that:

$$(TMS-250°\,C.)\leq TQ\leq(TMS+100°\,C.).$$

Having proven particularly favorable here is a quench temperature TQ between the martensite start temperature TMS and the martensite start temperature TMS−150° C. ((TMS−150° C.)≤TQ≤TMS).

If, however, the intention is to achieve a maximum martensite content in the structure of the flat steel product of the invention, it may also be useful to select low quench temperatures TQ, such as a temperature lying within the region of the room temperature.

Operation f):

The flat steel product quenched to the quench temperature TQ may optionally be coiled to give a coil after the operation e), in order to ensure the consistency and homogeneity of temperature within the whole material.

In this case it should be borne in mind, however, that the temperature of the flat steel product must not fall by more than 80° C. below the quench temperature TQ.

Operation g):

After the cooling, the hot-rolled flat steel product cooled to the quench temperature TQ is held for a time of 0.1-48 hours in a temperature range from TQ −80° C. to TQ +80° C., in order to ensure the target transformations and also, when using the micro-alloy elements, to ensure the formation of finely distributed carbides.

The aim of this operation is the formation of a martensitic structure which may contain up to 15 vol % of residual austenite. Practical tests here have shown that this result is generally obtained at holding times of just up to 2.5 hours in general in the case of hot strips composed of the steel as per the invention. With a view to the utilization of energy, therefore, it may be useful to limit the holding time to a maximum of 2.5 hours longer holding times do no harm and are therefore selected if to do so makes sense with a view to the available plant technology or occupation thereof. Also having proven useful, moreover, are holding times of at least one hour, in order to achieve complete homogeneity of temperature in the material and, hand in hand with this, to achieve the formation of an up to 15 vol % residual austenite fraction within the martensitic structure.

The holding within the temperature range from TQ −80° C. to TQ +80° C. may take place either isothermally, in other words at constant temperature, or nonisothermally, in other words with falling or rising or oscillating temperature.

If there is plant-related cooling in the course of holding, the maximum allowable cooling rate is 0.05 K/s.

The redistribution and transformation events taking place during holding may, however, also proceed exothermically, thus liberating heat of transformation which causes the temperature of the flat steel product to rise. The heat of transformation in that case counteracts any possible cooling. The self-heating rates for this nonisothermal development of structure are at most 0.01 K/s.

The rate at which temperature changes occur during the holding, starting from the respective quench temperature TQ, is therefore typically in the range from −0.05 K/s to +0.01 K/s.

The holding conditions must be selected so that the mandated temperature window of TQ+/−80° C. is maintained in spite of the temperature changes that come about.

Operation h):

The aim of this operation, also referred to as partitioning, is to establish a structure of martensite, tempered martensite and, optionally, residual austenite.

In operation h) the flat steel product, starting from its temperature established after operation g), is brought to a partitioning temperature TP or, if the partitioning temperature TP is in the range fluctuating by +/−80° C. around the quench temperature TQ, is maintained at that temperature in order to enrich the residual austenite with carbon from the supersaturated martensite.

The partitioning temperature TP ought advantageously to be at least as high as the quench temperature TQ, but preferably at least 50° C. higher, more particularly at least 100° C. higher.

If the partitioning temperature TP is lower than the temperature present after operation g) (quench temperature TQ+/−80° C.), then the carbon mobility is too low to bring about stabilization of the residual austenite. Moreover, the tempering effect of the primary martensite does not occur to the desired degree.

The partitioning temperature TP for the steels of the invention is at most 500° C., more particularly at most 470° C., in order to achieve the optimum tempering state.

The partitioning time tPT is between 30 minutes and 30 hours, in order to allow sufficient redistribution of the carbon without disintegration of the residual austenite present in the structure.

The partitioning time tPT here is made up of the time tPR (heating ramp) needed for the heating procedure, and the time tPI intended for the isothermal holding; tPI here may also be zero.

The proportions of the times tPR and tPI within the partitioning time tPT are variable, provided the overall partitioning time tPT mandated in accordance with the invention is observed.

Where the flat steel product heated in operation h) is a product coiled into a coil, the hot strip is heated ideally at a heating rate θP1 of up to 1 K/s. Heating rates θP1 below 0.005 K/s do not appear to be practical. At heating rates θP1>1 K/s, there may be unallowable differences in the temperature between outer, middle, and inner turns of the coiled hot strip. These differences ought to amount at most to 85° C., in order to ensure uniform physical properties over the entire length of the hot-rolled flat steel product produced in accordance with the invention.

The formation of pearlite and the disintegration of residual austenite are suppressed in a targeted way by means of a modified hold time at a defined temperature.

It has emerged as being advantageous in process terms if the time tPI is zero. In this case, the desired structure is established solely during the heating procedure, i.e., within the time tPR.

As already mentioned, the partitioning temperature may also be the same as the temperature possessed by the flat steel product after operation g) (quench temperature TQ+/−80° C.), meaning that there is no time tPR for heating of the flat steel product.

The partitioning (operation h)) is preferably accomplished batchwise in a batch annealing furnace, which allows slow heating of the hot strip, which in this case is necessarily coiled into a coil.

Annealing in a batch annealing furnace gives rise to the following advantages:

In the course of the heating, relatively small temperature gradients occur, and so the heating-through of the material is more uniform. The maximum heating rate is guided on the one hand by the target temperature and on the other hand by the respective input weight in the batch annealing furnace. If heating is too rapid, the strip is not heated through with complete uniformity. That results in a nonuniform structure, more particularly in a different martensite morphology, which affects the further partitioning behavior and therefore the ultimate structure. This is particularly the case with heating assemblies which are integrated directly into the hot strip line (continuous annealing or inline induction annealing as in the case of US 2014/0299237, for example). A nonuniform structure leads to poor deformability, and in particular to a poorer hole expansion.

Slow heating, conversely, leads to a uniform redistribution of carbon from the martensite into the austenite, thus on the one hand preventing the unwanted formation of coarse carbides and on the other hand allowing an adjustment to the fraction of carbon-enriched austenite in the ultimate structure. Heating that is too rapid causes the carbon to build up at crystallographic defects, such as phase boundaries and dislocations, for example, and so promotes the precipitation of transition carbides and/or cementite. This leads to a reduction in the proportion of carbon available for stabilizing the austenite during the partitioning step, and hence to a nonuniform structure. Adjusting the heating conditions adapted to the kinetics of carbon redistribution during the partitioning step therefore makes it possible to establish a uniform structure with improved forming properties, in particular with improved hole expansion.

For the establishment of uniform properties over both the length and the width of the flat steel product, the maximum heating rate θP1 during the partitioning step is 1 K/s, preferably 0.075 K/s, since otherwise there are local nonuniformities associated with reduced forming properties, more particularly an impaired hole expansion. It is particularly favorable if the heating takes place at a heating rate θP1 of at most 0.03 K/s, in order to ensure optimum homogeneity of the final structure and hence ideal hole expansion and long-term strength properties.

The minimum heating rate θP1, for reasons of economics, is 0.005 K/s, preferably 0.01 K/s.

A further advantage of the use of a batch annealing furnace is that the particular target annealing temperatures can be set more precisely than in continuous annealing furnaces. Annealing takes place, moreover, in an inert gas mixture, allowing harmful effects on the hot strip surface—oxidation, for example—to be avoided. Inert gas used comprises hydrogen, nitrogen, and also mixtures of hydrogen and nitrogen. Furthermore, partitioning in a separate batch annealing furnace allows decoupling in cycle time relative to the hot-rolling line. This enables better utilization of the hot-rolling capacities.

Where a batch annealing furnaceis used in operation h), the transport of the flat steel product into the batch annealing furnace within operation g) ought to take place in a manner which takes account of the provisos explained above in relation to accordance with the temperature TQ.

After operation h), the hot-rolled flat steel product is cooled to room temperature. Cooling in operation i) ought to take place at a cooling rate θP2 of at most 1 K/s, in order to be able to control the stress in the flat steel product. For reasons of economics, a minimum cooling rate of 0.01 K/s can be applied.

It is self-evident that if the flat steel product is in strip form and has been coiled into a coil in the optional operation f), it can now be decoiled and, for logistical reasons, divided into what are called strip sheets.

Depending on the particular end-use intended, it may be useful for the flat steel product of the invention that is obtained or constituted to be subjected to a surface treatment, such as descaling, pickling or the like.

It may also be useful to provide the flat steel product with protection from corrosion in a conventional way, with a metallic coating. This may be done by means of electrogalvanizing, for example.

A flat steel product of the invention or produced in accordance with the invention is processed in the hot-rolled state. This allows thicknesses of the flat steel product of 1 mm or more, with typically thicknesses lying in the range of 1.5-10 mm.

The hot-rolled flat steel product of the invention is particularly suitable for structural lightweight construction, since the higher strength permits a reduction to be made in the thickness of material. Conventional higher-strength and ultra high-strength grades are not suitable for more substantially formed parts, since they lack the necessary formability.

The flat steel product constituted in accordance with the invention, moreover, permits integration of components, since the good formability in spite of high strength enables a plurality of components of an assembly to be replaced by one component made from hot-rolled flat steel product of the invention.

For motor vehicle chassis parts in particular, moreover, the increased hole expansion is advantageous, and is substantially facilitated by the shaping of through-points. Inadequate hole expansion in grades available to date, in the strength range of more than 800 MPa, has been considered a criterion for exclusion for use for chassis parts. The cyclical loading to which chassis parts are typically subject requires the material, moreover, ideally to have good long-term strength.

Furthermore, the improved formability in conjunction with reduced thickness of material for reasons of lightweight construction allows new component geometries.

The advantages of flat steel products of the invention within a motor vehicle can also be utilized in the areas of the drive chain and also for interior parts and transmission parts.

In the metalworking industry, the mechanical properties of flat steel products of the invention can be utilized for the lightweight construction of stamped parts. Integration of components as well harbors the possibility of saving on joining operations and hence at the same time increasing manufacturing reliability and generating cost advantages.

The use of the flat steel products of the invention in the construction industry is likewise advantageous since they exhibit improved formability in conjunction with high strength. Furthermore, they possess an increased yield strength ratio in comparison to other flat steel products at the comparable strength level. These properties ensure improved stability of constructions in the event of unforeseen load scenarios such as earthquakes, impact loads or exceedance of the structurally envisaged maximum loading.

The invention is elucidated in more detail below with working examples.

In the tables set out below, the examples not in accordance with the invention are marked with a "*", and values in the respective examples that lie outside the mandates of the invention are underlined.

To test the invention, experimental melts A-O having the compositions specified in table 1 were melted.

Table 2, for the steels A-O, reports the A3 temperatures determined as per equation (1) and the martensite start temperatures TMS determined as per equation (2).

For 47 experiments, the melts A-O were cast into slabs, which were subsequently each heated to a reheating temperature TWE. The slabs thus heated were then rolled conventionally into hot strip with a thickness of 2-3 mm, the hot-rolling in each case comprising, likewise conventionally, rough rolling and final rolling, and ending in each case at a hot-rolling end temperature TET.

Within a maximum of 5 s after the end of hot-rolling, i.e., in the technical sense, directly after the hot-rolling, the hot-rolled steel strips obtained were quenched in each case at a cooling rate θQ to a respective quench temperature TQ at which they were subsequently held for a duration tQ. The hot strips later subjected to batch annealing were coiled into a coil between the quenching and the holding.

After the holding, the hot strips were heated with a heating rate θP1 for a duration tPR to a respective partitioning temperature TP, where they were held for a duration tPI.

Lastly, the hot strips obtained in experiments 1-47 were cooled to room temperature.

The parameters of reheating temperature "TWE", hot-rolling end temperature "TET", cooling rate "θQ", quench temperature "TQ", hold time "tQ", heating rate "θP1", hold time "tPI", partitioning temperature "TP", and heating time "tPR" are reported for each of the experiments 1-47 in table 3.

Additionally, in table 3, for each of the experiments, the assembly used for the partitioning treatment (operation h)) and the respective difference between the quenching temperature TQ and the partitioning temperature TP are identified. When a batch annealing furnace is used, there is also an indication in each case of whether it was used for raising ("heating") the temperature or for keeping the temperature constant ("holding").

The mechanical-technological properties of "yield strength RP0.2", "tensile strength Rm", "RP0.2/Rm ratio", "elongation A", and "hole expansion value λ" present in the hot-rolled steel strips obtained in experiments 1-47, as present after manufacturing, are specified in table 4.

Table 5 gives the proportions of polygonal ferrite "pF", nonpolygonal ferrite "npF", tempered martensite "AM", cementite "Z", residual austenite "RA", nontempered martensite "M", and bainite "B" in the structure, and also the KAM of the hot strips obtained in experiments 1-47.

In the case of the noninventive experiment 7, the value required in accordance with the invention for hole expansion was not achieved, since the quenching was terminated at excessive temperatures.

Conversely, experiments 3-6 produced an increase in the hole expansion by 7% to 38% relative to the noninventive comparative experiment 7, with a simultaneous avoidance of too high a proportion of bainite. Hence in experiments 3-5 there were only traces of bainite, and in experiment 6 10 area % of bainite, whereas in the case of experiment 7 there were 20 area % of bainite in the structure.

Experiments 11-13 show the need to carry out rolling above the A3 temperature and to observe a sufficiently long hold time to.

With melts D and E, success was achieved in producing a material having a strength of 1028-1500 MPa and a hole expansion of 22-87%.

However, in the case of the noninventive experiment 24, the manufacturing parameters lead to the formation of too high a proportion of bainite.

With the noninventive melt F, it was impossible to prevent the formation of cementite in spite of a sufficiently long hold time (see experiment 29).

The melt M, as an example of a variant with optimized surface quality, combines a reduced Si content with an increased Al content. In the case of low TET at the same time (see experiment 45), a proportion of 5 area % of polygonal ferrite is formed in the structure, thereby enabling low yield strengths in conjunction with good hole expansion.

Whereas the melts A-M and O were produced under conventional operational conditions, melt N was produced as a laboratory melt in a vacuum furnace. With the high-purity melt N, success was achieved in generating a material with very good hole expansion (see experiment 46).

Experiment 47 with the melt analysis O shows that when all of the manufacturing parameters are observed, it is possible to fabricate a material with values that are still just sufficient in respect of the elongation at break and the hole expansion.

TABLE 1

| Melt | C | Si | Mn | Al | P | S | N | Cr | V | Mo | Ti | Nb | B | Ni |
|---|---|---|---|---|---|---|---|---|---|---|---|---|---|---|
| A* | 0.145 | 0.24 | 2.15 | 0.660 | 0.011 | 0.0017 | 0.0033 | 0.71 | — | — | 0.028 | 0.027 | — | — |
| B | 0.186 | 1.52 | 2.54 | 0.025 | 0.009 | 0.0021 | 0.0021 | 0.25 | — | — | 0.041 | — | 0.0019 | — |
| C | 0.249 | 1.71 | 1.89 | 0.019 | 0.011 | 0.0015 | 0.0025 | 0.17 | — | 0.102 | 0.027 | — | — | — |

TABLE 1-continued

| Melt | C | Si | Mn | Al | P | S | N | Cr | V | Mo | Ti | Nb | B | Ni |
|---|---|---|---|---|---|---|---|---|---|---|---|---|---|---|
| D | 0.201 | 1.46 | 1.98 | 0.028 | 0.013 | 0.0013 | 0.0032 | — | — | 0.100 | 0.017 | — | — | — |
| E | 0.179 | 1.51 | 2.05 | 0.021 | 0.007 | 0.0025 | 0.0029 | 0.14 | — | — | — | — | — | 0.13 |
| F* | 0.150 | 0.29 | 1.82 | 0.027 | 0.015 | 0.0027 | 0.0041 | 0.37 | — | 0.101 | 0.047 | — | 0.0010 | — |
| G | 0.174 | 1.10 | 1.62 | 0.017 | 0.006 | 0.0019 | 0.0052 | — | — | — | — | — | — | — |
| H | 0.242 | 0.75 | 1.74 | 0.920 | 0.005 | 0.0014 | 0.0018 | — | 0.150 | — | — | — | — | — |
| I* | 0.152 | 0.74 | 1.27 | 0.017 | 0.007 | 0.0014 | 0.0045 | 0.32 | — | — | — | — | — | — |
| J | 0.204 | 1.23 | 2.49 | 0.012 | 0.010 | 0.0008 | 0.0022 | 0.14 | — | — | — | — | — | 0.321 |
| K | 0.123 | 1.37 | 2.62 | 0.023 | 0.008 | 0.0012 | 0.0019 | — | — | 0.224 | — | 0.035 | — | 0.820 |
| L | 0.166 | 1.49 | 2.01 | 0.024 | 0.011 | 0.0015 | 0.0025 | 0.105 | — | — | 0.028 | — | 0.0011 | — |
| M | 0.177 | 0.90 | 2.02 | 1.47 | 0.008 | 0.0012 | 0.0016 | 0.12 | — | — | — | — | — | 0.52 |
| N | 0.166 | 1.55 | 2.01 | — | — | — | — | — | — | — | — | — | — | — |
| O | 0.183 | 1.47 | 2.51 | 0.026 | 0.092 | 0.026 | 0.0076 | 0.18 | — | — | — | — | 0.0008 | — |

Figures in wt %, balance iron and unavoidable impurities
*= not inventive

TABLE 2

| Melt | A3 [° C.] | TMS [° C.] |
|---|---|---|
| A* | 787 | 357 |
| B | 817 | 342 |
| C | 834 | 340 |
| D | 828 | 352 |
| E | 832 | 357 |
| F* | 797 | 366 |
| G | 826 | 372 |
| H | 792 | 351 |
| I* | 829 | 383 |

TABLE 2-continued

| Melt | A3 [° C.] | TMS [° C.] |
|---|---|---|
| J | 795 | 335 |
| K | 816 | 341 |
| L | 835 | 363 |
| M | 798 | 351 |
| N | 836 | 364 |
| O | 816 | 344 |

*= not inventive

TABLE 3

| Experiment | Melt | TWE [° C.] | TET [° C.] | ⊖Q TQ [K/s] | [° C.] | tQ [s] | ⊖P1 [K/s] | tPI [s] | TP [° C.] | tPR [s] | TP − TQ [° C.] | Annealing assembly | Inventive? |
|---|---|---|---|---|---|---|---|---|---|---|---|---|---|
| 1 | A | 1230 | 910 | 45 | 345 | 3000 | 0.075 | 10800 | 410 | 867 | 65 | batch furnace (heating) | NO |
| 2 | A | 1230 | 920 | 50 | 295 | 950 | 0.03 | 10200 | 425 | 4333 | 130 | batch furnace (heating) | NO |
| 3 | B | 1250 | 900 | 50 | 195 | 4500 | 0.05 | 18600 | 300 | 2100 | 105 | batch furnace (heating) | YES |
| 4 | B | 1240 | 890 | 50 | 205 | 7200 | 0.08 | 14200 | 450 | 3063 | 245 | batch furnace (heating) | YES |
| 5 | B | 1250 | 905 | 45 | 255 | 5400 | 0.04 | 16000 | 400 | 3625 | 145 | batch furnace (heating) | YES |
| 6 | B | 1270 | 900 | 40 | 345 | 6300 | 0.02 | 18400 | 350 | 250 | 5 | batch furnace (holding) | YES |
| 7 | B | 1250 | 905 | 38 | 475 | 12600 | — | =tQ | 395 | — | −80 | batch furnace (holding) | NO |
| 8 | B | 1160 | 845 | 52 | 165 | 2400 | 0.02 | 85200 | 280 | 5750 | 115 | batch furnace (heating) | YES |
| 9 | B | 1230 | 910 | 62 | 325 | 4100 | 2.5 | 2200 | 385 | 24 | 60 | continous line | NO |
| 10 | C | 1240 | 850 | 37 | 350 | 9000 | 0.02 | 14500 | 425 | 3750 | 75 | batch furnace (heating) | YES |
| 11 | C | 1230 | 890 | 43 | 245 | 3500 | 0.03 | 21300 | 400 | 5167 | 155 | batch furnace (heating) | YES |
| 12 | C | 1240 | 895 | 51 | 195 | 8500 | 0.04 | 21600 | 410 | 5375 | 215 | batch furnace (heating) | YES |
| 13 | C | 1210 | 915 | 58 | 265 | 0 | 5 | 14800 | 400 | 27 | 135 | continuous line | NO |
| 14 | D | 1250 | 920 | 25 | 350 | 12100 | — | =tQ | 350 | — | 0 | batch furnace (holding) | NO |
| 15 | D | 1250 | 920 | 41 | 320 | 5500 | 0.025 | 21900 | 405 | 3400 | 85 | batch furnace (heating) | YES |
| 16 | D | 1250 | 920 | 48 | 290 | 3100 | 0.045 | 12300 | 450 | 3556 | 160 | batch furnace (heating) | YES |
| 17 | D | 1180 | 880 | 58 | 28 | 19900 | 0.01 | 12700 | 255 | 22700 | 227 | batch furnace (heating) | YES |
| 18 | D | 1230 | 905 | 42 | 25 | 3000 | 0.01 | 12800 | 445 | 42000 | 420 | batch furnace (heating) | YES |
| 19 | D | 1200 | 910 | 41 | 290 | 160000 | 0.06 | 12500 | 395 | 1750 | 105 | batch furnace (heating) | YES |
| 20 | D | 1250 | 890 | 48 | 380 | 8700 | — | 12900 | 400 | — | 20 | batch furnace (holding) | YES |
| 21 | E | 1200 | 910 | 35 | 335 | 7900 | 0.03 | 21500 | 390 | 1833 | 55 | batch furnace (heating) | YES |
| 22 | E | 1190 | 895 | 42 | 295 | 4050 | 0.06 | 14400 | 420 | 2083 | 125 | batch furnace (heating) | YES |
| 23 | E | 1220 | 890 | 50 | 240 | 6020 | 0.04 | 14900 | 405 | 4125 | 165 | batch furnace (heating) | YES |
| 24 | E | 1210 | 895 | 42 | 365 | 10500 | 0.03 | 8900 | 525 | 5333 | 160 | batch furnace (heating) | NO |
| 25 | E | 1250 | 855 | 35 | 26 | 7200 | 0.03 | 21500 | 455 | 14300 | 429 | batch furnace (heating) | YES |
| 26 | E | 1260 | 895 | 42 | 170 | 4200 | 0.06 | 14400 | 245 | 1250 | 75 | batch furnace (heating) | YES |
| 27 | E | 1210 | 915 | 50 | 230 | 6700 | 0.04 | 14900 | 450 | 5500 | 220 | batch furnace (heating) | YES |
| 28 | E | 1270 | 920 | 42 | 375 | 2200 | 0.075 | 19400 | 390 | 200 | 15 | batch furnace (holding) | YES |
| 29 | F | 1250 | 925 | 35 | 350 | 19900 | — | =tQ | 370 | — | 20 | batch furnace (holding) | NO |
| 30 | F | 1250 | 925 | 46 | 275 | 3000 | 0.03 | 16400 | 400 | 4167 | 125 | batch furnace (heating) | NO |
| 31 | G | 1240 | 920 | 39 | 305 | 160000 | 0.07 | 12300 | 395 | 1286 | 90 | batch furnace (heating) | YES |
| 32 | G | 1220 | 900 | 37 | 315 | 8700 | 0.035 | 12600 | 380 | 1857 | 65 | batch furnace (heating) | YES |
| 33 | G | 1250 | 915 | 31 | 525 | 7200 | −0.02 | 13100 | 405 | 6000 | −120 | None | NO |
| 34 | H | 1240 | 900 | 36 | 325 | 4200 | 0.04 | 12300 | 415 | 2250 | 90 | batch furnace (heating) | YES |
| 35 | H | 1210 | 895 | 24 | 365 | 6700 | 0.02 | 12100 | 395 | 1500 | 30 | batch furnace (heating) | NO |
| 36 | H | 1220 | 890 | 35 | 335 | 170000 | 0.01 | 12700 | 380 | 4500 | 45 | batch furnace (heating) | YES |
| 37 | I | 1240 | 905 | 41 | 315 | 8400 | 0.01 | 12800 | 375 | 6000 | 60 | batch furnace (heating) | NO |
| 38 | J | 1230 | 910 | 45 | 260 | 7100 | 0.06 | 12500 | 400 | 2333 | 140 | batch furnace (heating) | YES |
| 39 | K | 1240 | 905 | 37 | 315 | 9300 | 0.035 | 12600 | 450 | 3857 | 135 | batch furnace (heating) | YES |
| 40 | K | 1250 | 915 | 42 | 345 | 2450 | 0.02 | 0 | 405 | 3000 | 60 | batch furnace (heating) | YES |

TABLE 3-continued

| Experiment | Melt | TWE [° C.] | TET [° C.] | ⊖Q TQ [K/s] | [° C.] | tQ [s] | ⊖P1 [K/s] | tPI [s] | TP [° C.] | tPR [s] | TP − TQ [° C.] | Annealing assembly | Inventive? |
|---|---|---|---|---|---|---|---|---|---|---|---|---|---|
| 41 | L | 1260 | 850 | 35 | 290 | 123000 | — | =tQ | 260 | — | −30 | batch furnace (holding) | YES |
| 42 | L | 1160 | 920 | 46 | 340 | 2350 | 0.03 | 10200 | 405 | 2167 | 65 | batch furnace (heating) | YES |
| 43 | L | 1240 | 910 | 39 | 390 | 4500 | — | 17100 | 390 | — | 0 | batch furnace (holding) | YES |
| 44 | L | 1230 | 915 | 37 | 45 | 7200 | 0.03 | 21500 | 245 | 6667 | 200 | batch furnace (heating) | YES |
| 45 | M | 1200 | 795 | 39 | 331 | 8000 | 0.02 | 22000 | 395 | 3200 | 64 | batch furnace (heating) | YES |
| 46 | N | 1150 | 950 | 45 | 345 | 2300 | 0.03 | 11000 | 410 | 2167 | 65 | batch furnace (heating) | YES |
| 47 | O | 1220 | 910 | 52 | 310 | 7500 | 0.07 | 15000 | 440 | 1857 | 130 | batch furnace (heating) | YES |

TABLE 4

| Experiment | Melt | $R_{P02}$ [MPa] | $R_m$ [MPa] | $R_{P02}/R_m$ | A [%] | λ [%] | Inventive ? |
|---|---|---|---|---|---|---|---|
| 1 | A | 601 | 1128 | 0.53 | 14.5 | 16 | NO |
| 2 | A | 759 | 1134 | 0.67 | 12.8 | 17 | NO |
| 3 | B | 1281 | 1482 | 0.85 | 7.9 | 34 | YES |
| 4 | B | 1125 | 1214 | 0.93 | 10.2 | 43 | YES |
| 5 | B | 1177 | 1317 | 0.89 | 8.8 | 55 | YES |
| 6 | B | 1027 | 1325 | 0.78 | 9 | 23 | YES |
| 7 | B | 807 | 1270 | 0.64 | 12.7 | 17 | NO |
| 8 | B | 1210 | 1446 | 0.84 | 9.2 | 27 | YES |
| 9 | B | 1170 | 1345 | 0.87 | 6.1 | 35 | NO |
| 10 | C | 865 | 1220 | 0.71 | 16.2 | 32 | YES |
| 11 | C | 1090 | 1380 | 0.79 | 13.1 | 27 | YES |
| 12 | C | 1209 | 1412 | 0.86 | 10.9 | 23 | YES |
| 13 | C | 1232 | 1441 | 0.85 | 5.9 | 31 | NO |
| 14 | D | 690 | 1253 | 0.55 | 13.2 | 13 | NO |
| 15 | D | 974 | 1124 | 0.87 | 12 | 54 | YES |
| 16 | D | 876 | 1056 | 0.83 | 15.6 | 47 | YES |
| 17 | D | 1299 | 1500 | 0.87 | 9.1 | 22 | YES |
| 18 | D | 1052 | 1102 | 0.95 | 12.7 | 36 | YES |
| 19 | D | 1178 | 1241 | 0.95 | 11 | 55 | YES |
| 20 | D | 1054 | 1149 | 0.92 | 13.3 | 49 | YES |
| 21 | E | 836 | 1187 | 0.7 | 16.8 | 34 | YES |
| 22 | E | 851 | 1072 | 0.79 | 14 | 56 | YES |
| 23 | E | 913 | 1059 | 0.86 | 12.3 | 67 | YES |
| 24 | E | 680 | 1015 | 0.67 | 17.1 | 16 | NO |

TABLE 4-continued

| Experiment | Melt | $R_{P02}$ [MPa] | $R_m$ [MPa] | $R_{P02}/R_m$ | A [%] | λ [%] | Inventive ? |
|---|---|---|---|---|---|---|---|
| 25 | E | 975 | 1028 | 0.95 | 12.3 | 41 | YES |
| 26 | E | 1189 | 1431 | 0.83 | 9 | 66 | YES |
| 27 | E | 1028 | 1064 | 0.97 | 12.4 | 51 | YES |
| 28 | E | 999 | 1059 | 0.94 | 11.9 | 87 | YES |
| 29 | F | 945 | 1104 | 0.86 | 5.8 | 18 | NO |
| 30 | F | 1067 | 1189 | 0.90 | 4.9 | 43 | NO |
| 31 | G | 857 | 1017 | 0.84 | 12.7 | 49 | YES |
| 32 | G | 821 | 1043 | 0.79 | 13.5 | 38 | YES |
| 33 | G | 457 | 984 | 0.46 | 11.3 | 5 | NO |
| 34 | H | 868 | 1109 | 0.78 | 14 | 63 | YES |
| 35 | H | 523 | 1061 | 0.49 | 15.9 | 7 | NO |
| 36 | H | 824 | 1197 | 0.69 | 13.6 | 29 | YES |
| 37 | I | 670 | 965 | 0.69 | 10.8 | 17 | NO |
| 38 | J | 1043 | 1267 | 0.82 | 9.5 | 47 | YES |
| 39 | K | 804 | 1029 | 0.78 | 14.1 | 25 | YES |
| 40 | K | 871 | 1040 | 0.84 | 11.2 | 22 | YES |
| 41 | L | 1209 | 1420 | 0.85 | 8.1 | 24 | YES |
| 42 | L | 1043 | 1107 | 0.94 | 11.4 | 48 | YES |
| 43 | L | 935 | 1071 | 0.87 | 8.6 | 42 | YES |
| 44 | L | 1211 | 1396 | 0.87 | 7.1 | 21 | YES |
| 45 | M | 822 | 1176 | 0.7 | 17.2 | 29 | YES |
| 46 | N | 1055 | 1121 | 0.94 | 9.8 | 51 | YES |
| 47 | O | 1194 | 1221 | 0.98 | 7.2 | 27 | YES |

TABLE 5

| Experiment | Melt | pF [Area %] | npF [Area %] | AM [Area %] | Z [Area %] | RA [Vol %] | M [Area %] | B [Area %] | KAM [°] | Inventive ? |
|---|---|---|---|---|---|---|---|---|---|---|
| 1 | A | 0 | 20 | 65 | — | 8.5 | 5 | Tr. | 1.19 | NO |
| 2 | A | 0 | 25 | 70 | — | 4.5 | 0 | Tr. | 1.14 | NO |
| 3 | B | 0 | 0 | 80 | — | 1 | 16 | Tr. | 1.51 | YES |
| 4 | B | 0 | 0 | 80 | — | 0 | 19 | Tr. | 1.53 | YES |
| 5 | B | 0 | 0 | 75 | — | 2 | 21 | Tr. | 1.54 | YES |
| 6 | B | 0 | 0 | 65 | — | 0 | 24 | 10 | 1.5 | YES |
| 7 | B | 0 | 0 | 60 | — | 10.5 | 9.5 | 20 | 1.48 | NO |
| 8 | B | 0 | 0 | 85 | — | 2 | 13 | Tr. | 1.62 | YES |
| 9 | B | 0 | 0 | 30 | — | 2.5 | 65 | Tr. | 1.57 | NO |
| 10 | C | 5 | 0 | 65 | — | 5 | 20 | 5 | 1.5 | YES |
| 11 | C | 0 | 0 | 80 | — | 8 | 10 | Tr. | 1.53 | YES |
| 12 | C | 0 | 0 | 85 | — | 4.5 | 10 | Tr. | 1.56 | YES |
| 13 | C | 0 | 0 | 35 | — | 0 | 65 | Tr. | 1.49 | NO |
| 14 | D | 20 | 0 | 35 | — | 8.5 | 20.5 | 15 | 1.42 | NO |
| 15 | D | 0 | 0 | 70 | — | 3 | 25 | Tr. | 1.55 | YES |
| 16 | D | 0 | 0 | 75 | — | 0 | 25 | 0 | 1.51 | YES |
| 17 | D | 0 | 0 | 75 | 5.00 | 3.5 | 15 | 0 | 1.5 | YES |
| 18 | D | 0 | 0 | 85 | — | 1.5 | 13 | Tr. | 1.56 | YES |
| 19 | D | 0 | 0 | 75 | — | 5.5 | 15 | 2 | 1.6 | YES |
| 20 | D | 0 | 0 | 60 | Tr. | 1.5 | 25 | 12 | 1.58 | YES |
| 21 | E | 0 | 0 | 60 | — | 7.5 | 30 | Tr. | 1.51 | YES |
| 22 | E | 0 | 0 | 75 | — | 2 | 20 | Tr. | 1.54 | YES |
| 23 | E | 0 | 0 | 85 | — | 0 | 15 | 0 | 1.57 | YES |
| 24 | E | 0 | Tr. | 35 | Tr. | 1.5 | 38 | 25 | 1.37 | NO |
| 25 | E | 0 | 3 | 65 | — | 1.5 | 30 | 0 | 1.53 | YES |
| 26 | E | 0 | 0 | 80 | — | 2 | 15 | Tr. | 1.61 | YES |
| 27 | E | 0 | 0 | 70 | Tr. | 10.5 | 15 | 2 | 1.52 | YES |
| 28 | E | 0 | 0 | 70 | — | 2 | 15 | 13 | 1.53 | YES |
| 29 | F | 0 | 5 | 35 | 15 | 4.5 | 20 | 20 | 1.45 | NO |
| 30 | F | 0 | Tr. | 60 | 5 | 6 | 20 | 7 | 1.47 | NO |

TABLE 5-continued

| Experiment | Melt | pF [Area %] | npF [Area %] | AM [Area %] | Z [Area %] | RA [Vol %] | M [Area %] | B [Area %] | KAM [°] | Inventive ? |
|---|---|---|---|---|---|---|---|---|---|---|
| 31 | G | 0 | 0 | 75 | Tr. | 8.5 | 15 | Tr. | 1.53 | YES |
| 32 | G | 0 | 0 | 70 | — | 5.5 | 23 | Tr. | 1.51 | YES |
| 33 | G | 20 | 0 | 0 | Tr. | 6 | 30 | 42 | 1.38 | NO |
| 34 | H | 0 | 0 | 50 | — | 8 | 38 | 4 | 1.53 | YES |
| 35 | H | 25 | 0 | 5 | Tr. | 6.5 | 60 | Tr. | 1.32 | NO |
| 36 | H | 0 | 0 | 50 | Tr. | 11.5 | 37 | Tr. | 1.51 | YES |
| 37 | I | 18 | 0 | 55 | — | 1.5 | 20 | 5 | 1.41 | NO |
| 38 | J | 3 | 0 | 70 | Tr. | 3 | 20 | 2 | 1.62 | YES |
| 39 | K | 0 | Tr. | 60 | — | 4.5 | 35 | 0 | 1.51 | YES |
| 40 | K | 0 | 2 | 50 | — | 1.5 | 46 | Tr. | 1.55 | YES |
| 41 | L | 10 | Tr. | 75 | 2.50 | 1 | 10 | Tr. | 1.5 | YES |
| 42 | L | 0 | 0 | 60 | Tr. | 8.5 | 30 | 0 | 1.55 | YES |
| 43 | L | 0 | 0 | 70 | — | 2.5 | 25 | Tr. | 1.52 | YES |
| 44 | L | 0 | 0 | 85 | Tr. | 0.5 | 12 | Tr. | 1.57 | YES |
| 45 | M | 0 | 5 | 60 | — | 6 | 27 | Tr. | 1.52 | YES |
| 46 | N | 0 | 0 | 75 | — | 5 | 20 | 0 | 1.63 | YES |
| 47 | O | 0 | 0 | 82 | — | 1 | 13 | Tr. | 1.5 | YES |

The invention claimed is:

1. A hot-rolled flat steel product comprising a steel having the following composition (in wt %):

C: 0.1-0.3%,
Mn: 1.5-3.0%,
Si: 0.5-1.8%,
Al: up to 1.5%,
P: up to 0.1%,
S: up to 0.03%,
N: up to 0.008%, and
a balance being iron and impurities, wherein the flat steel product has a tensile strength Rm of 800-1500 MPa, a yield strength Rp of more than 700 MPa, an elongation at break A of 7-25%, and a hole expansion λ of more than 20%, wherein a structure of the flat steel product comprises at least 85 area % of martensite, of which at least half is tempered martensite, with the respective remainder of the structure comprising at least one of up to 15 vol % residual austenite, up to 15 area % bainite, up to 15 area % polygonal ferrite, up to 5 area % cementite and up to 5 area % nonpolygonal ferrite, and wherein the structure of the flat steel product has a kernel average misorientation KAM of at least 1.50°.

2. The hot-rolled flat steel product of claim 1, wherein the Al content is up to at most 0.03 wt %.

3. The hot-rolled flat steel product of claim 1, wherein the Si content is at least 1.0 to 1.8 wt %.

4. The hot-rolled flat steel product of claim 1, wherein the Al content is at least 0.5 to 1.5 wt %.

5. The hot-rolled flat steel product of claim 1, wherein the Si content is up to at most 1.1 wt %.

6. The hot-rolled flat steel product of claim 1, wherein the hot-rolled flat steel product is at least 1.0 mm thick.

7. The hot-rolled flat steel product of claim 1, further comprising one or more elements selected from the group consisting of Cr, Mo, Ni, Nb, Ti, V, and B, wherein:

Cr: 0.1-0.3%,
Mo: 0.05-0.25%,
Ni: 0.05-2.0%,
Nb: 0.01-0.06%,
Ti: 0.02-0.07%,
V: 0.1-0.3%, and
B: 0.0008-0.0020%.

8. The hot-rolled flat steel product of claim 1, wherein the structure of the flat steel product contains substantially no ferrite.

9. The hot-rolled flat steel product of claim 1, wherein the structure of the flat steel product contains no polygonal ferrite.

10. A process for producing the flat steel product of claim 1, comprising:

a) melting of a steel alloy having the following composition (in wt %):

C: 0.1–0.3%,
Mn: 1.5–3.0%,
Si: 0.5–1.8%,
Al: up to 1.5%,
P: up to 0.1%,
S: up to 0.03%,
N: up to 0.008%, and
a balance being iron and unavoidable impurities;

b) casting of the melt to give a semi-finished product;

c) heating-through of the semi-finished product to a heating temperature TWE of 1000-1300° C.;

d) hot-rolling of the heated-through semi-finished product to give a hot strip having a thickness of 1.0-20 mm, the hot-rolling being ended at a hot-rolling end temperature TET, wherein TET>(A3–100° C.), where A3 designates the respective A3 temperature of the steel;

e) quenching of the hot strip, starting from the hot-rolling end temperature TET, at a cooling rate θQ of more than 30 K/s, to a quench temperature TQ wherein RT<TQ<(TMS+100° C.), where RT designates room temperature and TMS designates the martensite start temperature of the steel, and where the martensite start temperature TMS is determined as follows:

$$TMS[°\,C.]=462-273\%\,C-26\%\,Mn-13\%\,Cr-16\%\,Ni-30\%\,Mo$$

where % C=C content of the steel, % Mn=Mn content of the steel, % Cr=Cr content of the steel, % Ni=Ni content of the steel, and % Mo=Mo content of the steel, in each case in wt %;

f) holding of the flat steel product, cooled to the quench temperature TQ, within a temperature range from TQ −80° C. to TQ +80° C. over a time of 0.1-48 hours;

g) at least on of heating the flat steel product to a partitioning temperature TP and holding the flat steel product at a partitioning temperature TP which is at least equal to the temperature TQ+/−80° C. of the flat steel product as present after step f), and is at most 500°

C., over a partitioning time tPT of 0.5-30 hours, wherein if heating takes place, the heating rate θP1 is at most 0.075 K/s; and h) cooling of the flat steel product to room temperature.

11. The process of claim 10, wherein step g) is carried out in a batch annealing furnace.

12. The process of claim 10, wherein the heating rate θP1 is not more than 0.03 K/s.

13. The process of claim 10, wherein in step c) the heating temperature TWE is 1150-1250° C.

14. The process of claim 10, wherein the quench temperature TQ in step e) is at most equal to the martensite start temperature TMS and greater than the martensite start temperature TMS minus 250° C.

15. The process of claim 14, wherein the quench temperature TQ lies between the martensite start temperature TMS and greater than the martensite start temperature TMS minus 150° C.

16. The process of claim 10, wherein the holding time in step f) is 0.1 to not more than 2.5 hours.

17. The process of claim 10, wherein the partitioning temperature TP in step g) is at least 50° C. higher than the quench temperature TQ and at most 500° C.

18. The process of claim 10, wherein the flat steel product further comprises one or more elements selected from the group consisting of Cr, Mo, Ni, Nb, Ti, V, and B, wherein:

Cr: 0.1-0.3%,
Mo: 0.05-0.25%,
Ni: 0.05-2.0%,
Nb: 0.01-0.06%,
Ti: 0.02-0.07%,
V: 0.1-0.3%, and
B: 0.0008-0.0020%.

19. The process of claim 10, further comprising coiling of the flat steel product to give a coil after quenching to the quench temperature TQ in step e).

20. The process of claim 10, further comprising descaling the flat steel product after step h).

21. The process of claim 20, further comprising coating the flat steel product after descaling.

* * * * *